United States Patent [19]

Miller

[11] 4,131,896

[45] Dec. 26, 1978

[54] DIPOLE PHASED ARRAY WITH CAPACITANCE PLATE ELEMENTS TO COMPENSATE FOR IMPEDANCE VARIATIONS OVER THE SCAN ANGLE

[75] Inventor: Coleman J. Miller, Twin Harbors, Md.

[73] Assignee: Westinghouse Electric Corp., Pittsburgh, Pa.

[21] Appl. No.: 823,484

[22] Filed: Aug. 10, 1977

Related U.S. Application Data

[63] Continuation of Ser. No. 656,913, Feb. 10, 1976, abandoned.

[51] Int. Cl.[2] ..... H01Q 3/26; H01Q 19/00

[52] U.S. Cl. ..... 343/815; 343/854; 343/909

[58] Field of Search ..... 343/754, 854, 872, 815, 343/909

[56] References Cited

U.S. PATENT DOCUMENTS

| | | | |
|---|---|---|---|
| 3,633,206 | 1/1972 | McMillan | 343/872 |
| 3,701,157 | 10/1972 | Uhrig | 343/708 |
| 3,858,221 | 12/1974 | Harrison et al. | 343/815 |
| 3,936,835 | 2/1976 | Phelan | 343/753 |

*Primary Examiner*—Eli Lieberman

*Attorney, Agent, or Firm*—W. E. Zitelli

[57] ABSTRACT

A phased array of dipoles mounted above a ground plane and including capacitance plate elements made of conductive metal mounted at greater distances from ground plane than the dipoles to compensate for variations in impedance over the scan angle of the phase array. With appropriate choice of the dimensions of the capacitance plate, the spacing between the dipole elements and the ground plane, and the spacing between the capacitance plates and the ground plane, the variation of input impedance over the scan angle is greatly reduced for H-plane scan.

13 Claims, 9 Drawing Figures

DIPOLE PHASED ARRAY WITH CAPACITANCE PLATE ELEMENTS TO COMPENSATE FOR IMPEDANCE VARIATIONS OVER THE SCAN ANGLE

This is a continuation of application Ser. No. 656,913, filed Feb. 10, 1976, now abandoned.

BACKGROUND OF THE INVENTION

Field of the Invention:

The present invention relates to improvements in phased arrays of dipole, or dipole-like radiating elements. It is of particular utility in two-dimensional, or so-called M × N arrays.

Description of the Prior Art:

One of the important performance criteria for electronically scanned dipole arrays is the variation of input impedance with scan angle. The larger the variation, the greater the reflected power with its attendant loss. In prior art apparatus, these variations have been the cause of significant losses. For example, over a 60-degree scan angle, the impedance variation is about six to one for E-plane scan and nearly four to one for H-plane scan. Since these occur in different directions, an optimization of source impedance results in a peak voltage standing wave ratio (VSWR) of nearly 5. This causes a loss due to reflected energy of about 2.5 db at the worst scan angle.

There are several known prior art techniques which reduce the impedance variation under E-plane scan, making it less than the H-plane variation, and/or cause it to occur in the same direction as the H-plane variation. One of these modifications is the bending of the dipole so that the outer tips are closer to the ground plane than the center. Another involves putting baffles between adjacent dipoles. The improvement provided by these techniques is considerable, for example resulting in a reduction of the VSWR to about 2.5, yielding a maximum loss of about 0.88 db. However, as far as known there is nothing in the prior art which gives any significant improvement in the H-plane impedance variation.

While there has been no known technique of reducing variation of impedance under H-plane scan, the techniques of controlling directivity pattern characteristics by interjecting metallic discs, rods or plates in the field adjacent the dipole radiating element is disclosed in prior art patents. One patent which is notable for its physical resemblance to the present invention is U.S. Pat. 3,742,513 FIG. 4 thereof discloses reflector discs above the radiating element of an array. However the principle of that patent is the achievement of directivity through the use of the the discs as backfire reflectors. Also, a rim, of variable length, comes out of the ground plane, forming a cavity for enhancing the beam directivity. The size of the reflector disc is not specified, but in accordance with the well known principles of design of backfire antennas, it is presumed to have a diameter of λ/2.

Also of interest are prior art patents which disclose discs, or plates in connection with a single radiating element (and not in an array organization). These include U.S. Patents 3,774,223 and 2,671,855 disclosing disk reflectors of λ/2 and 0.8 λ diameter, respectively, acting as backfire reflectors for cavity or parabolic main reflecting surfaces; Patent 2,429,640, which discloses a rectangular plate having transverse dimensions which are multiples of λ/2 acting as a backfire reflector into a parabolic directive reflector; 3,483,043 and 3,508,278 which disclose reflector discs of λ/2 diameter, (or in the case of 3,508,278 the alternative having 1/10 of the main reflector area in a backfiring reflector); and 2,759,182 which discloses a paraboloidal curved rectangular plate having a major dimension 0.96λ and a minor dimension of 0.63λ in the backfiring reflector configuration. In all instances the dimensions are either specified to be in excess of λ/2 or may be presumed to be equal to or greater than λ/2 from well known design principles for backfiring reflectors. The function of the disk, rods or plates in all these cases is to achieve directivity.

Also of interest are various patents in which discs or plates are used as non-active directors in forming a beam as a connection with a dipole radiating element. Patent 3,821,745 discloses an assembly of a bent plate having a linear dimension between $\frac{1}{4}\lambda$ and $\frac{1}{2}\lambda$, and a rectangular planar plate having a dimension $\frac{1}{3}\lambda$ which act as parasitic directors of the beam pattern; 2,556,046 discloses a disc having a diameter just under λ/2 which serves as a phase modifying driver; and 3,524,191 which discloses a yagi-type array composed of a multiplicity of elements for phase shift control to form an end-fire directive beam. Again, the sole function of the non-active elements is to form a beam. Except with regard to the yagi-type array of 3,524,191, the elements have major dimensions of λ/2 or more.

Prior to the present invention there has been no known use in dipole arrays of non-active disc or plate elements located beyond a dipole radiating element from the ground plane or reflector which serve to reduce variation of impedance of scan angle.

SUMMARY OF THE INVENTION

Briefly, the subject of the invention is a phased array of dipoles for producing an electronically scanned directive antenna beam which comprises an M × N array of dipole-type radiating elements mounted above a ground plane. A pattern of capacitance plates made of conductive metal are supported in positions above the dipoles and in parallel relationship to the ground plane. These capacitance plates serve the function of compensating for variations in impedance with scan angle. The pattern is such that the plurality of capacitance plates are symmetrically located relative to the feed points of the dipole-type radiating elements to uniformly distribute the capacitive effect imparted by them to the near field adjacent the ground plane. The effective axes of the dipole-type radiating elements are all uniformly spaced from the ground plane by distance, Z, in the range $\frac{1}{8}\lambda$ to $\frac{1}{4}\lambda$, where λ is the array operating wavelength. The plurality of capacitance plates are uniformly spaced from the ground plane by a distance, $Z_c$, which is of the order of twice the distance from the ground plane to the effective axes of the radiating elements. The radiating element units may be composed of crossed dipole-type radiators for a circular polarization array, or may be composed of single dipole-type radiators for a linear polarization array. In the case of the circular polarization array, the capacitance plates may be square, round, or consist of cross strips, and are of a finite size in which their diameter or major dimensions are no greater than $\frac{1}{4}\lambda$. In the case of a linear polarization array, the capacitance plates may be rectangular or elliptical, and in such case their major dimension is no greater than $\frac{1}{4}\lambda$. The size of capacitance plates, distance above the ground plane of the effective dipole axes, and distance above the ground plane of the capacitance plates are optimized through conventional "waveguide simulator" techniques. When this optimization is done, the variation of impedance under scan in the H-plane relative to the either of the dipole axes direction of a crossed-type configuration, or in the H-plane relative to the dipole axes of the single dipole elements of a linear polarization configuration, is greatly reduced.

DESCRIPTION OF THE PREFERRED EMBODIMENT

Figure 1:
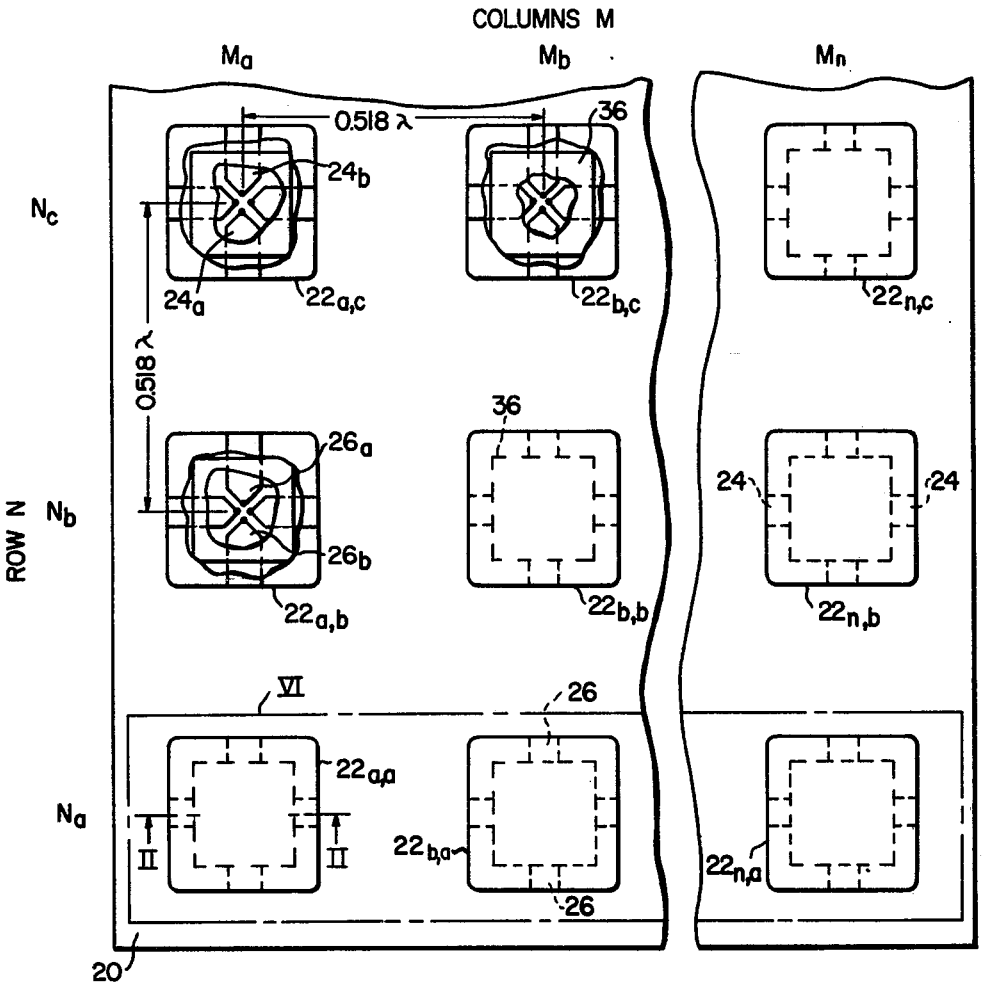
FIG. 1 is a side elevational view of an M × N (rectangular) array of crossed dipole-type radiating units in accordance with the present invention, portions of which are successively cut-away to reveal details of the internal structure of capacitance plates and radiating elements.
Figure 6:
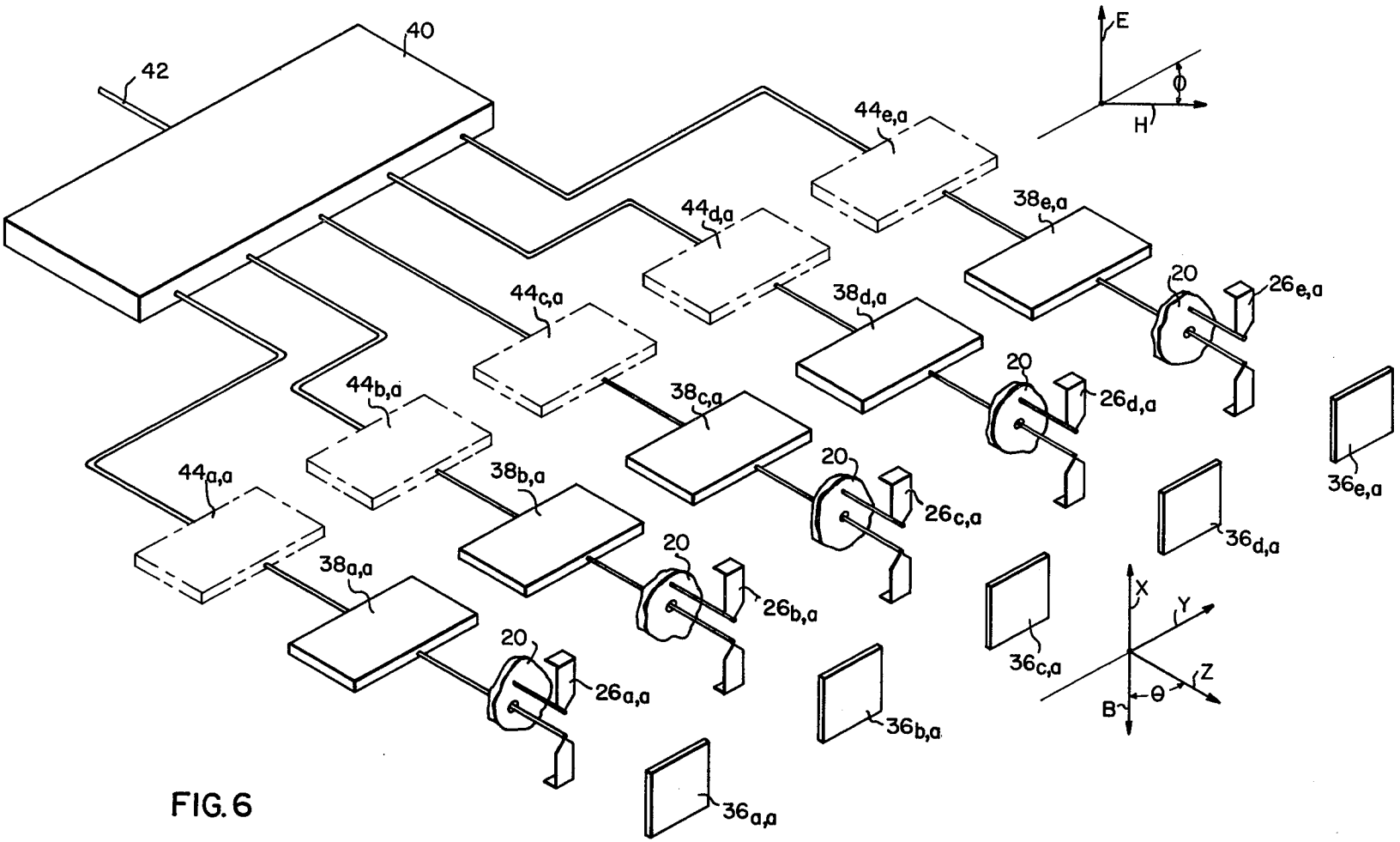
FIG. 6 is a representation of the row of radiating elements enclosed by phantom line box VI of FIG. 1, but simplified to show only the vertically oriented dipole-type radiating elements of each crossed pair of dipole-type radiating elements shown in order to better facilitate a description of H-plane scan.

Referring now to the drawings and in particular to FIG. 1, an M × N rectangular array comprises a ground plane conductor 20 having mounted to its beam projecting side a plurality of radiating element and capacitance plate assemblies 22. The directions of the major dimensions of the array are designated the X and Y coordinates as indicated in FIG. 6 and the direction of beam formation is designated the Z coordinate. The radiating element and capacitance plate subassemblies are arranged in a series of columns, M, aligned in the X direction and a series of rows, N, aligned in the Y direction. The sequence of columns as they extend in the Y direction are designated $M_a$, $M_b$, . . . $M_n$. The sequence of rows as they extend in the X direction are designated $N_a$, $N_b$, $N_c$. The location of a given radiating element and capacitance plate assembly in terms of the columns and rows is indicated by subscript letters following the reference numeral. The first subscript letter is the letter of the column in which the assembly is located. The second subscript letter is the letter of the row in which the subassembly is located. The dimensions shown on the drawing are in wavelengths, λ, of the nominal operating wavelength of the array and represent a typical set of optimized dimensions which are determined in accordance with the teachings hereof through the technique of modeling a radiating element structure using waveguide simulators. This technique of modeling is discussed in the book edited by R. C. Hansen, "Microwave Scanning Antennas," Academic Press, 1966, pages 322 to 333. The trial and error process of determining optimized dimensions may be speeded up by use of computer programs which emulate waveguide simulators. As shown in FIG. 1, the radiating element and capacitance plate assemblies 22 are separated by a distance 0.518 λ center-to-center distance in both the X and Y directions.

Figure 3:
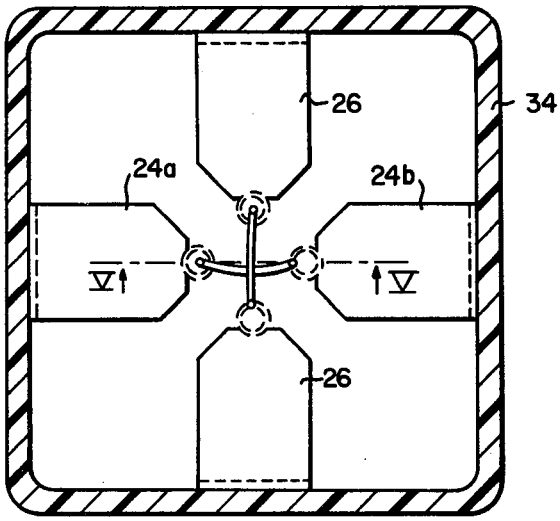
FIG. 3 is a view taken along line III—III of FIG. 2.
Figure 2:
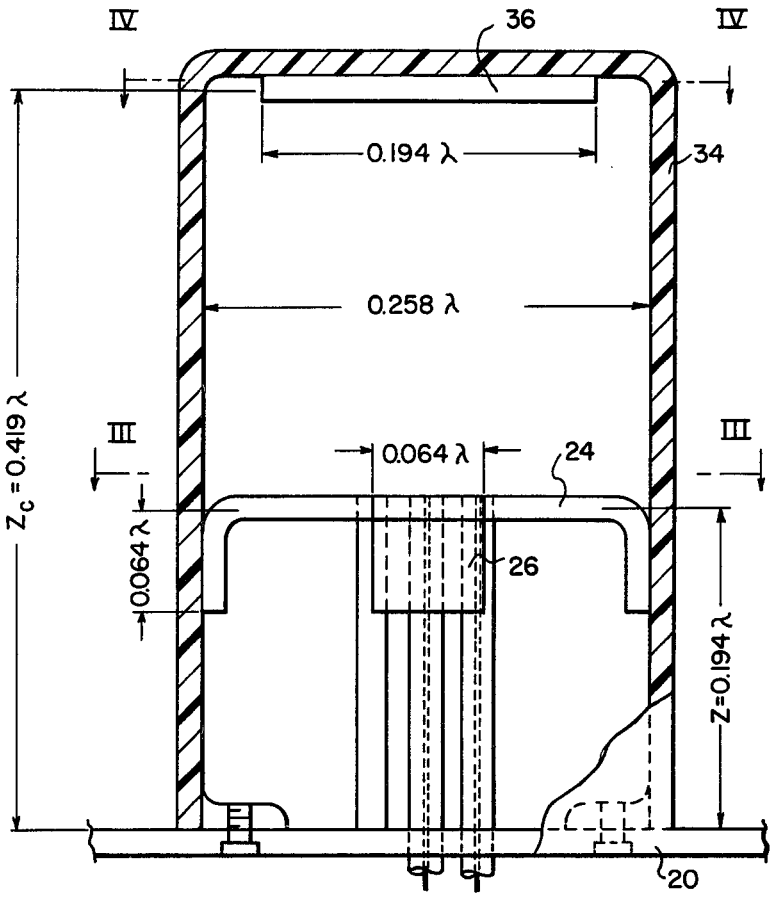
FIG. 2 is an enlarged cross-section taken along line II—II of FIG. 1.
Figure 4:
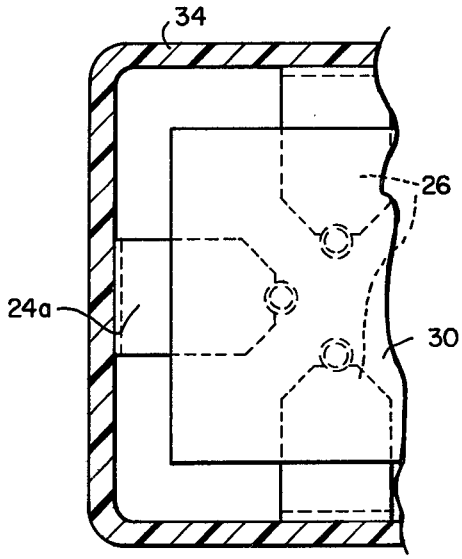
FIG. 4 is a fragment of a view taken along line IV—IV of FIG. 2.
Figure 5:
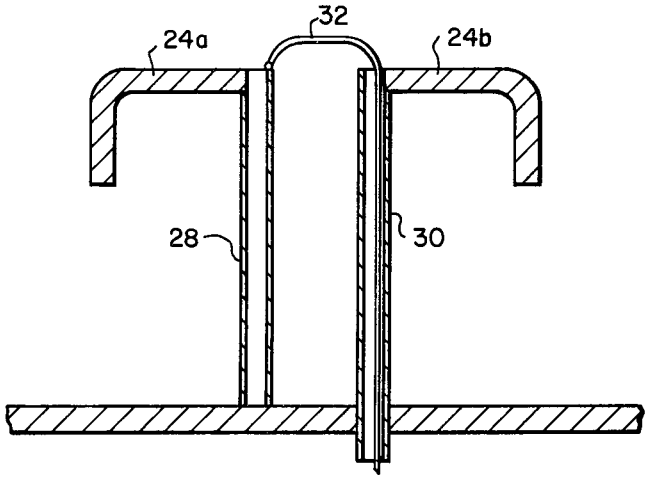
FIG. 5 is a section taken along line V—V of FIG. 3.
Figure 9:
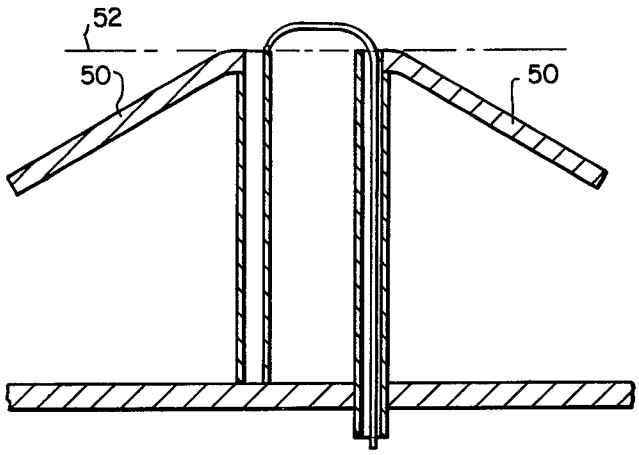
FIG. 9 is a view like FIG. 5, but of an alternative construction of dipole-type radiating element.

Reference is now made to FIGS. 2, 3, and 4, for details of each radiating element and capacitance plate assembly 22. A crossed pair of bent dipoles 24 and 26 are supported with their effective dipole axes a distance Z = 0.194 λ from ground plane 20. Bent dipoles 24 are oriented in the Y direction and comprise opposed half-dipole members **24*a* and 24*b*, which divaricate from a feed point therebetween. Each half-dipole member is made of metal strip material and has an outer tip portion of a length 0.064 λbent at 90 degrees back toward the ground plane conductor 20. In the H-plane, this configuration is analytically the equivalent of a straight dipole. In the E-plane, the 90° bend provides the same function as the alternate arrangement shown in FIG. 9. The alternate arrangement of FIG. 9 is known in the prior art, and is referenced later in this specification. An axis through the expanses of the half-dipole which are not bent toward the ground plane 20 is the effective dipole axis for purposes of analytic treatment of this configuration. Bent dipole 26 has its effective dipole axis aligned in the X direction and is identical in construction to dipole 24. As best seen in FIG. 5, dipole 24 is fed by a conventional balun arrangement comprising a tubular post 28 which extends from the surface of ground plane conductor 20 to the inner end of half-dipole 24*a*, and another tubular post 30 which projects through the ground plane conductor 20 and serves as a conduit for the r.f. line 32. The end of r.f. line 32 is connected to the inner end of half-dipole element 24*a*. The feed arrangement for bent dipole element 26 is the same. The width dimension of bent dipole elements 24 and 26 is 0.064λ. A radome housing 34 made of low r.f. loss material is affixed to ground plane conductor 20. Housing 34 has a square cross-sectioned interior with the dimensions so chosen that bent tip portions of bent dipole elements 24 and 26 abut against the walls, whereby the housing 34 provides alignment support for the dipole elements. The inner surface of the end wall of housing 34 in the Z direction is a support surface to which is affixed a square capacitance plate 36. Plate 36 is 0.194 λ across its square dimensions. The distance at which the housing support plate 36 is above ground plane 20** is $Z_c$ = 0.419λ.

The pair of crossed dipole elements 24 and 26 provide circular polarization of the beam projecting in the direction Z. Plate 36 imparts capacitance to the near field adjacent the ground plate conductor 20, and in the context of a linear array of subassemblies 22, this minimizes the variation of input impedance of the radiating elements under H-plane electrical scanning in the various rows and columns of radiating elements. The mechanism by which the plates minimize such impedance variation will be understood from an analytical discussion to be hereinafter presented.

Reference is now made to FIG. 6 for a description of H-plane scanning which occurs with respect to the bent dipole elements in the columns M, and rows N of the array under electronic scanning for moving the directivity beam in the column and row planes. FIG. 6 represents all the vertically oriented bent dipole elements 26 in row $N_a$. The illustration of H-plane scan for this one row will serve as an example for the similar H-plane scannings which occur relative to each of the orientation of bent dipole elements in each of the rows and columns of radiating elements under electronic scanning of the M × N array in the row and column planes. For simplicity the row is shown as containing five radiating elements. It is to be understood that in operational embodiments of low frequency arrays, a single row would typically contain 50 radiating elements. The radiating elements 26 are mounted at a distance Z from ground plane 20 with their feeds extending therethrough. The capacitor plates 36 are supported in parallel relation to the ground plane at a distance $Z_c$ therefrom. Associated with each radiating element is a phase shifter 38. A power interconnecting network 40 provides power division in the transmission mode and power combining in the receive mode to divide, or merge, as the case may be, the r.f. energy between a single r.f. line 42 and the individual radiator element feed lines. The phase shifters 38 are individually controlled by external means not part of the invention to provide varying electrical phase shift increments in the individual feed lines to cause the direction of the radiation beam, B, to be controllably scanned through a scan angle $\theta$ from direction Z in the X-Z plane, as indicated in the drawing. Also as indicated in the drawing, the direction of electrical force line, E, of the row of bent dipole radiating elements 26, is aligned in the X direction, and the direction of magnetic force field, H, is in the Y-Z plane. Accordingly, the scan of the beam direction, B, through an angle $\theta$ constitutes an H-plane scan of the row of radiating elements $26_{a,a}$, $26_{b,a}$, . . . $26_{e,a}$ of FIG. 6. Amplifiers 44, shown in phantom line, are optionally included in the feed lines of the individual radiating elements. They are conventionally adapted to be switched to provide amplification in the proper direction during the transmitting and receiving modes. In some cases, mixers are provided in this network and phase shifters 38 and power dividers and combiners 40 are operated at an intermediate (i.f.) frequency. The construction and operation of phase shifters 38 to provide the electronic scanning, and the construction and operation of power interconnecting network 40 are conventional and well known. It will be appreciated that, in the total organization of the M × N array, the control of the direction of the beam in both the column and row planes is achieved by corresponding control of phase shifters in the feed lines to the radiating elements 24 and 26 in each of columns M and N.

The mathematical relationship of certain of the position and size dimensions to the achievement of minimization of variation of input impedances presented by bent dipole radiating elements $26_{a,a}$ through $26_{e,a}$ of FIG. 6 under H-plane scanning will be presently explored. This will include an examination of the configurations of an electrical field (derived through Maxwell's equations) in three dimensions above the ground plane 20 when r.f. waves approach the ground plane at various scan angles $\theta$. Then the effect of the augmented capacitance produced by capacitance plates $36_{a,a}$ through $36_{e,a}$ in this region will be examined.

The electric field of a wave approaching normal to ground plane 20 and having a polarization selected to place the electric field vector in the Y direction, is described by Maxwell's equations as follows:

$$E = Ae^{-j\left(\omega t - \frac{2\pi X}{\lambda}\sin\theta - \frac{2\pi Z}{\lambda}\cos\theta\right)}$$

wherein A is a complex number describing the amplitude and phase of the wave; $\omega$ is 2 $\pi$ times the frequency; and $\lambda$ is the free space wavelength. When this wave strikes the ground plane, a reflection occurs which propagates at the angle $-\theta$, and which has the same amplitude as E but the opposite phase. This reflected electrical wave is described mathematically as $$E_R = Ae^{-j\left(\omega t - \frac{2\pi X}{\lambda}\sin\theta + \frac{2\pi Z}{\lambda}\cos\theta\right)}$$

combining these gives a total electrical field:

$$E_T = Ae^{-j\left(\omega t - \frac{2\pi X}{\lambda}\sin\theta\right)}\left[e^{j\frac{2\pi Z}{\lambda}\cos\theta} - e^{-j\frac{2\pi Z}{\lambda}\cos\theta}\right]$$

which can be transformed into:

$$E_T = 2Ae^{-j\left(\omega t - \frac{2\pi X}{\lambda}\sin\theta - \frac{\pi}{2}\right)}\sin\left(\frac{2\pi Z}{\lambda}\cos\theta\right)$$

An examination of the variation of $E_T$ with Z for any given value of X, reveals that regardless of the value of X, the magnitude of $E_T$ is:

$$|E_T| = 2|A|\sin\left(\frac{2\pi Z}{\lambda}\cos\theta\right)$$

For $\theta = 0°$, this function reaches a peak of 2A at a distance of ¼ wavelength above the ground plane, which is a typical position for a dipole radiating element. At this point the current induced in a resonant dipole should be in the proper phase to cancel the reflected wave, as a necessary condition for a so-called "matched system", i.e., a system in which the radiating element effectively couples with the configuration of the r.f. field. As $\theta$ increases to 60°, the peak field moves up to ½ wavelength above the ground plane, and at a distance of ¼ wavelength the direct and reflected waves are 90° out of phase. In order that a radiating element located ¼ wavelength above the ground would satisfy the conditions for a matched system, the element would have to be made highly reactive to shift the phase of the induced current so that it could cancel the reflected wave. This would destroy the match at $\theta = 0$. Thus, it is impossible to use a dipole radiating element alone at its typical ¼ wavelength position above the ground plane and maintain the input impedance it presents to its feed line within reasonable bounds under $\theta$ scan.

The effect of the addition of some capacity at a distance, $Z_c$, which is greater than the distance from the ground plane to the radiating element, Z, will now be examined. Again, the field of interest is a field produced by a wave approaching the ground plane from space. A selection of capacitance may be made such that the fields at an angle $\theta = 90°$ in the region within distance $Z_c$ have a magnitude $$|E_T| = 2\,|A|\,\frac{Z}{Z_c}$$

In the region beyond $Z_c$ such field has a magnitude:

$$|E_T| = 2|A|$$

This indicates that in the region beyond $Z_c$, the phase of the reflected wave is shifted so that the direct and reflected waves are in phase. The radiating element, in order to maintain a match with the directed and reflected waves, should be resonant rather than highly reactive at large angles of $\theta$. The added capacity has an effect at $\theta = 0°$, but the phase of the reflected wave with respect to the direct wave still varies rapidly with the distance of the radiating element, Z. A position can be selected for the element which results in the reflected and direct waves being in phase. With the element at such position, the variation in reactance is small as $\theta$ is varied. It has been found through analytical studies performed by computer emulation of waveguide simulator models that the range of value for distance Z for effective operation should be between $\frac{1}{8}$ and $\frac{1}{4}\lambda$.

However, it is also necessary to control the resistance variation, and this is done by varying the distance $Z_c$ of the added capacity. As $Z_c$ is varied, the amount of capacity introduced and the height of the radiating element must be changed to keep the reactance variation small. It is to be noted that the larger the value of $Z_c$, the less the value of capacitance needed to meet this criteria. If $Z_c$ is increased and the corrective adjustments to the added capacity made, the resistance at large values of $\theta$ increases relative to the resistance for the value $\theta = 0°$, and vice versa. Thus, by optimum selection of $Z_c$, the resistance variation can be minimized. Through computer emulation of waveguide simulator models, it has been found that distance $Z_c$ should be of the order of twice the distance Z. Within this range, (i.e., $Z_c$ being an order of twice Z), it has been found that plates no larger than $\frac{1}{4}\lambda$ in both directions of a rectangular form, or in diameter of a disc, provide the desired amount of capacitance for minimizing resistance variation as $\theta$ is varied.

Figure 7:
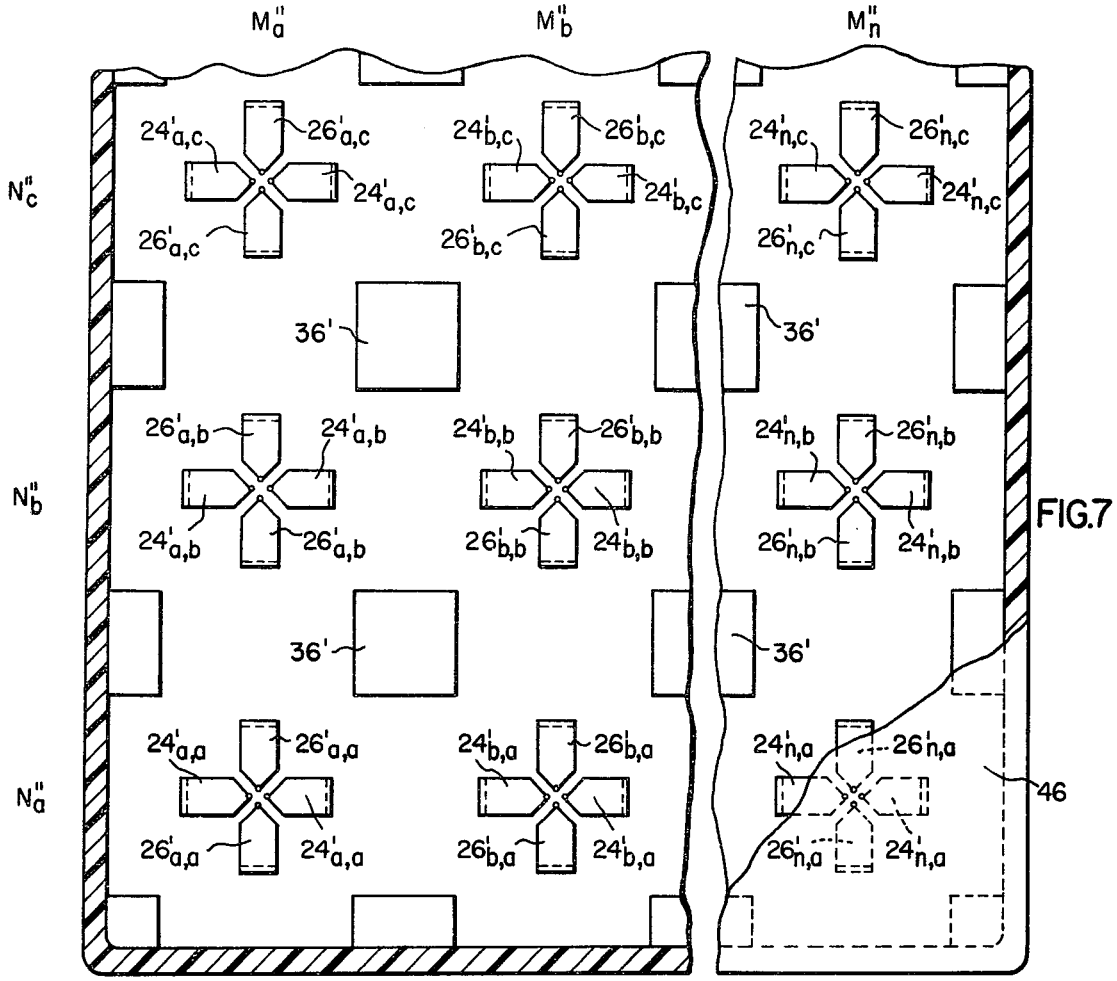
FIG. 7 is a view like FIG. 1, but of an alternate embodiment employing a different arrangement of capacitance plates, and having the majority of a radome covering wall cut-away to reveal the details of construction of the capacitance plates and radiating elements.
Figure 8:
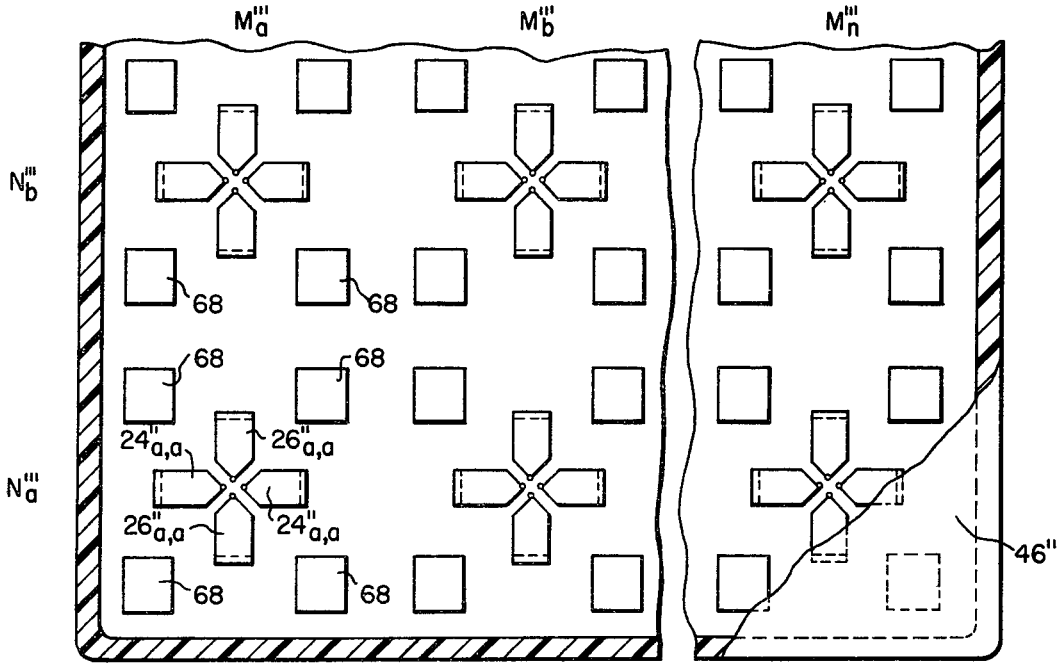
FIG. 8 is another view like FIG. 1, but of another alternate embodiment employing a still different arrangement of capacitance plates, and having a majority of a radome covering wall cut-away to reveal the details of construction of the capacitance plates and radiating elements.

It will be appreciated from the foregoing mathematical descriptions that the capacitative plates need not be located in alignment with the feed points of the radiating elements, and further that a larger number of smaller plates could be used. An alternate embodiment of the invention is shown in FIG. 7, wherein plates 36' have the same dimensions as plates 36 of FIG. 1, but are centered in the areas between crossed dipole units 24', 26'. A single radome has a wall which covers all the radiating elements and is spaced from the ground plane by the distance $Z_c$, so that the capacitance plates may be fixed to the inner surface of this covering wall. Note that fractional sizes of capacitance plates are disposed along the outer perimeter of the arrays so that the radiating elements near the perimeters have the same magnitude of capacitance imparted to them as those in the middle of the array. Another alternate embodiment of the invention is illustrated in FIG. 8 wherein a larger number of smaller capacitance plates 68 are employed to impart capacitance effects to the r.f. fields adjacent the positions of the radiating elements. Each elemental capacitance plate 48 has an area less than the area of plate 36, FIG. 1, and is disposed about each crossed pair of bent dipoles 24'', 26'', in a symmetrical arrangement relative to their respective effective dipole axes. As in the embodiment of FIG. 7, the capacitance plates are supported by attachment to a wall of a radome 46'' which is spaced a distance $Z_c$ from the ground plane. It will be appreciated that the common characteristic of construction of the arrangements of capacitance plates 36 of FIG. 1, plates 36' of FIG. 7, and plates 68 of FIG. 8 is that they are disposed in a predetermined pattern in which they are symmetrically located relative to the feed points and the effective dipole axes of the radiating elements.

Any of the dipole-type radiating element configurations may be employed as an alternative to the bent dipole type in which the dipole tips are bent at 90° toward the ground plane. For example, the type of bent dipole radiating element in which each dipole half is bent back toward the ground plane at an oblique angle from the feed point, illustrated as dipole element 50, FIG. 9 of may be employed. This type of bent dipole is known in the art. For example, refer to the publication edited by Dr. A. A. Oliver and Dr. D. H. Knittel, "Phased Array Antennas", published by Artech House, 1972. In the paper by L. Stark in this publication, entitled "Comparison of Array Element Types", this type of dipole is shown in FIG. 1 on page 51, in FIG. 11 on page 56, and is described on pages 56 and 57. In this case, the effective dipole axis, illustrated by broken line 52, is a linear axis through the feed point and parallel to the ground plane. Of course, straight dipole radiating elements of strip material (not shown), or round rods (not shown) may also be employed. However, these do not offer advantages in minimizing variation of input impedance through scan angle in the E-plane, as have been alluded to in the description of the prior art.

Experiments using the waveguide emulator techniques have been conducted to test the effectiveness of the M × N array of FIG. 1. When operated over a 150 MHz frequency band centered at 1,410 MHz, a maximum VSWR of 1.80 was found. At specific frequencies, a maximum VSWR of 1.30 or less was found. This is in contrast to reduction of impedance variation obtainable with E-plane techniques, only, which yield a VSWR of about 2.5. This order of impedance variation reduction is very significant in the construction of large low frequency phased arrays. The marginal cost of such arrays is typically millions of dollars per db, and the foregoing reduction of VSWR yields a reduction of loss of about 0.54 db.

Although the concept of the present invention has been disclosed in connection with a two-dimensional array, it is equally applicable to a one dimensional array, provided the arrangement is compatible with the scan motion specified. In this case the capacitance plates would be rectangular or oblong. However, the incentive for employing the invention with one-dimensional arrays is not as great, since the marginal cost of such arrays per increment of loss is nowhere near as great as with the two-dimensional arrays.

The invention may be applied with equal effectiveness to so-called triangular arrangements of radiating elements. Also the invention may be applied to rectangular arrays providing linear polarization.

The technique herein disclosed for reducing variation of impedance in H-plane scanning can be combined with the prior art techniques of bent dipoles and baffles for reducing variation in impedance in E-plane scanning.

I claim:

1. For use in a phase array of dipole-type radiating elements that provide a directive antenna beam electronically scanned in the H-plane over a wide angle, the combination comprising:

conductive means forming a ground plane;

a plurality of dipole-type radiating elements disposed on the beam projecting side of said ground plane and aligned along a linear array axis, each of said dipole-type radiating elements including a pair of opposed half-dipole members which divaricate from a feed point, said feed point being spaced from said ground plane by a distance substantially within the range one-eighth to one-fourth the nominal operating wavelength for the array, each of said dipole-type radiating elements having an effective dipole axis perpendicular to said linear array axis and parallel to said ground plane; and a plurality of capacitance plates for minimizing the variation in the input impedance of the radiating elements under wide angle H-plane electrical scanning of the radiating elements, said capacitance plates being made of conductive metal and supported by a low R.F. loss material in a reference plane that is parallel to said ground plane and disposed on said beam projecting side of the ground plane, said reference plane being spaced from said ground plane by a distance substantially within the range of one-fourth to one-half the nominal operating wavelength for the array, each of said capacitance plates being disposed in a predetermined pattern with at least some of the capacitance plates being nonaligned with the feed points of the dipole-type radiating elements in a direction perpendicular to the ground plane such that the plurality of capacitance plates are symmetrically located with respect to said feed points and with respect to the effective dipole axis of the dipole-type radiating elements, and having a predetermined shape of finite size which is less than one-fourth the nominal operating wavelength for the array in either its dimension parallel to or its dimension perpendicular to the linear array axis.

2. Apparatus in accordance with claim 1, wherein each half-dipole member of the pair of opposed half-dipoles is bent toward the ground plane.

3. For use in a phased array of dipole-type radiating elements that provide a directive antenna beam electronically scanned in the H-plane over a wide angle, the combination comprising:

conductive means forming a ground plane;

a plurality of dipole-type radiating elements disposed on the beam projecting side of said ground plane and aligned along a linear array axis, each of said dipole-type radiating elements including a pair of opposed half-dipole members which divaricated from the feed point, said feed point being spaced from said ground plane by a distance substantially within the range one-eighth to one-fourth the nominal operating wavelength for the array, each of said dipole-type radiating elements having an effective dipole axis perpendicular to said linear array axis and parallel to said ground plane; and a plurality of capacitance plates for minimizing the variation in the input impedance of the radiating elements under wide angle H-plane electrical scanning of the radiating elements, said capacitance plates being of a number greater than the number of dipole-type radiating elements and made of conductive metal supported by a low R.F. loss material in a reference plane that is parallel to said ground plane and disposed on said beam projecting side of the ground plane by a distance substantially within the range of one-fourth to one-half the nominal operating wavelength for the array, each of said capacitance plates being disposed in a predetermined pattern such that the plurality of capacitance plates are symmetrically located with respect to said feed points and with respect to the effective dipole axis of the dipole-type radiating elements, and having a predetermined shape of finite size which is less than one-fourth the nominal operating wavelength for the array in either its dimension parallel to or its dimension perpendicular to the linear array axis.

4. Apparatus in accordance with claim 3 wherein each half-dipole member of the pair of opposed half-dipoles is bent toward the ground plane.

5. For use in a phase array of dipole-type radiating elements that provide a directive antenna beam electronically scanned in the H-plane over a wide angle, the combination comprising:

conductive means forming a ground plane;

a plurality of dipole-type radiating elements disposed on the beam projecting side of said ground plane and aligned along a linear array axis, each of said dipole-type radiating elements including a pair of opposed half-dipole members which divaricate from a feed point, said feed point being spaced from said ground plane by a first predetermined distance, each of said dipole-type radiating elements having an effective dipole axis perpendicular to said linear array axis and parallel to said ground plane;

at least one housing made of low r.f. loss material covering said plurality of radiating elements; and a plurality of capacitance plates for minimizing the variation in the input impedance of the radiating elements under wide angle H-plane electrical scanning of the radiating elements, said capacitance plates being made of conductive metal and supported by said housing such that they lie in a reference plane that is parallel to said ground plane and disposed on said beam projecting side of the ground plane, said reference plane being spaced from said ground plane by a second predetermined distance, each of said capacitance plates being disposed in a predetermined pattern such that the plurality of capacitance plates are symmetrically located with respect to said feed points and with respect to the effective dipole axis of the dipole-type radiating elements, and having a predetermined shape of finite size which is less than one-fourth the nominal operating wavelength for the array in both its dimension parallel to and its dimension perpendicular to the linear axis.

6. Apparatus in accordance with claim 5 wherein the first predetermined distance is substantially within the range one-eighth to one-fourth the nominal operating wavelength for the array.

7. Apparatus in accordance with claim 5 wherein the second predetermined distance is substantially within the range of one-fourth to one-half the nominal operating wavelength for the array.

8. Apparatus in accordance with claim 5 wherein the housing is a radome which supports the capacitive plates from the ground plane.

9. Apparatus in accordance with claim 5 wherein each half-dipole member of the pair of opposed half-dipoles is bent toward the ground plane.

10. Apparatus in accordance with claim 5 wherein said predetermined pattern of the capacitance plates includes at least some capacitance plates aligned with the feed points of the dipole-type radiating elements in a direction perpendicular to the ground plane.

11. Apparatus in accordance with claim 5 wherein the number of capacitance plates is equal to the number of dipole-type radiating elements.

12. Apparatus in accordance with claim 11 wherein there exists a housing and dipole radiating element combination for each capacitive plate, said each housing supporting a capacitive plate from its correspondingly associated radiating element.

13. Apparatus in accordance with claim 12 wherein each housing is a radome.

* * * * *